US008182915B2

(12) United States Patent
Middeljans et al.

(10) Patent No.: US 8,182,915 B2
(45) Date of Patent: May 22, 2012

(54) SPINNING METHOD

(75) Inventors: Hendrik Middeljans, Dieren (NL); Eric Heuveling, Arnhem (NL); Bastiaan Krins, Dieren (NL); Johannes Frederick Boer, Arnhem (NL)

(73) Assignee: Diolen Industrial Fibers B.V., Arnhem (NL)

( * ) Notice: Subject to any disclaimer, the term of this patent is extended or adjusted under 35 U.S.C. 154(b) by 155 days.

(21) Appl. No.: 12/732,573

(22) Filed: Mar. 26, 2010

(65) Prior Publication Data

US 2010/0175361 A1 Jul. 15, 2010

Related U.S. Application Data

(62) Division of application No. 10/520,064, filed as application No. PCT/EP03/06786 on Jun. 26, 2003, now Pat. No. 7,731,876.

(30) Foreign Application Priority Data

Jul. 5, 2002 (EP) ..... 02015058

(51) Int. Cl.
*D02G 3/00* (2006.01)

(52) U.S. Cl. ..... 428/364; 428/395

(58) Field of Classification Search ..... 428/364, 428/395; 152/451; 57/243
See application file for complete search history.

(56) References Cited

U.S. PATENT DOCUMENTS

| | | | | |
|---|---|---|---|---|
| 4,202,855 | A | 5/1980 | Gerking et al. | |
| 5,092,381 | A * | 3/1992 | Feijen et al. | 152/451 |
| 5,173,310 | A | 12/1992 | Katou et al. | |
| 5,466,525 | A * | 11/1995 | Maria et al. | 428/357 |
| 5,925,460 | A * | 7/1999 | Hofs et al. | 428/364 |
| 5,928,587 | A | 7/1999 | Schippers | |
| 6,103,158 | A | 8/2000 | Schafer et al. | |
| 6,551,545 | B1 | 4/2003 | Hutter et al. | |

FOREIGN PATENT DOCUMENTS

| | | |
|---|---|---|
| EP | 0 334 604 | 3/1988 |
| EP | 0 826 802 | 3/1998 |
| EP | 1 079 008 | 2/2001 |
| JP | 05-195309 | 8/1993 |
| JP | 08-325868 A | 12/1996 |
| JP | 11-61550 | 3/1999 |

OTHER PUBLICATIONS

English-language translation of Office Action for Korean Patent Application No. 10-2005-7000221, mailed Aug. 5, 2010.

* cited by examiner

*Primary Examiner* — N. Edwards

(74) *Attorney, Agent, or Firm* — Oliff & Berridge, PLC

(57) ABSTRACT

A method is provided for spinning a multifilament thread from a thermoplastic material, including the steps of extruding the melted material through a spinneret with a plurality of spinneret holes into a filament bundle with a plurality of filaments, winding the filaments as thread after solidifying, and cooling the filament bundle beneath the spinneret, whereby in a first cooling zone the gaseous cooling medium is directed in such a way that it flows through the filament bundle transversely, the cooling medium leaving the filament bundle practically completely on the side opposite the inflow side, and in a second cooling zone beneath the first cooling zone, the filament bundle being cooled further essentially through self-suction of the gaseous cooling medium surrounding the filament bundle.

3 Claims, No Drawings

SPINNING METHOD

CROSS-REFERENCE TO RELATED APPLICATION

This application is a divisional application of U.S. patent application Ser. No. 10/520,064, filed Mar. 9, 2005, now U.S. Pat. No. 7,731,876, which is a U.S. national stage application of PCT/EP03/06786, filed Jun. 26, 2003, which claims priority to European Patent Application No. 02015058.7, filed Jul. 5, 2002, the disclosure of each of these applications is incorporated herein by reference in their entirety.

BACKGROUND

The present invention relates to a method for spinning a multifilament thread from a thermoplastic material comprising the steps of extruding the melted material through a spinneret with a plurality of spinneret holes to form a filament bundle comprising a plurality of filaments, winding the filaments as thread after solidifying, and cooling the filament bundle beneath the spinneret.

The present invention also relates to polyester filament yarns and cords which contain polyester filament yarns.

A method of this type is known from EP-A-1 079 008. The movement of freshly extruded filaments is supported during the spinning procedure by a stream of air. Cooling thus takes place essentially through a stream of cooling agent flowing parallel to the thread. Good results are generally achieved with this type of cooling, especially with high drawing-off speeds.

A two-step cooling method for spinning a multifilament thread from a thermoplastic material is disclosed in JP 11061550. In the first cooling zone, the air flow is directed in such a way that it reaches the filaments from one side or circumferentially, and in a second zone compressed air is blown into the upper section of the cooling zone so that there is a downward flow of air parallel to the filaments. The purpose of this is to produce filaments with physical properties that are as uniform as possible.

The cooling behavior of thermoplastic polymers is certainly complicated and dependent upon a series of parameters. Especially during the cooling process, differences in the double refraction might be created over the filament cross-section, since the filament skin cools faster than the inside of the filament, i.e., the filament core. This cooling process also leads to differences in the crystallization behavior of the filaments. The cooling thus determines the crystallization of the polymers in the filament to a large degree, which is noticeable in the later usage of the filaments, for example in drawing. It is desirable for a series of applications that a high degree of cooling is achieved as soon as possible after the extrusion, in order to encourage rapid crystallization.

The cooling processes of the prior art do not fulfill, or incompletely fulfill, these requirements.

SUMMARY

An object of the present invention is to provide a method for the effective cooling of extruded filaments, which thus leads to good crystallization, even at relatively low winding speeds.

The object is achieved with the method described herein in that the method is distinguished in that cooling is performed in two steps, the filament bundle being blown on with a gaseous cooling medium in the first cooling zone in such a way that the gaseous cooling medium flows through the filament bundle transversely and leaves the filament bundle practically completely on the side opposite the inflow side, and in a second cooling zone beneath the first cooling zone the filament bundle being cooled further essentially through self-suction of the gaseous cooling medium surrounding the filament bundle.

DETAILED DESCRIPTION OF EMBODIMENTS

The method thus deals with a two-step cooling procedure. In the first step, a gaseous cooling medium flows through the filament, and the cooling agent leaves the filament bundle practically completely on the side opposite the inflow side. In this step of the cooling process, the cooling medium should thus not be drawn along with the filament if possible. To execute this first cooling step, the gaseous cooling medium may be directed to flow through the filament bundle transversely to the direction in which the filament bundle is moving, so that a so-called transverse air flow is provided. This air flow can be effectively created by sucking off the gaseous cooling medium with a suction device after it has passed through the thread bundle. A well-directed cooling stream is thus achieved and it is ensured that the cooling agent quantitatively leaves the filament bundle. The design can thus be effected in such a way that the filament bundle is guided between a blowing device and a suction device, for example. Another possibility would be to split the filament flow and to place a blowing device mid-way between two filament flows for example, such as through a perforated tube running parallel to and between the filament flows for a certain distance. The gaseous cooling medium can then be blown from the center of the filament bundle through the filament bundle to the outside. Again, it is important to ensure that the cooling medium leaves the bundle practically completely.

Of course, creating the air flow and suction in the other direction is also possible, for example by having the tube running through the center of the filament streams serve as a suction device and the blowing then takes place from outside to inside.

In the method of the invention, it is preferred for the flow speed of the gaseous cooling medium to be between 0.1 and 1 m/s. At these speeds, a uniform cooling mostly without intermingling or creation of skin/core difference during crystallization can be achieved.

Further, it has proven to be completely adequate if the first cooling zone has a length between 0.2 and 1.2 m.

Blowing over these lengths and under the conditions described above, the desired degree of cooling in the first zone or step is reached.

The second step of cooling is carried out using the so-called "self suction yarn cooling" wherein the filament bundle pulls the gaseous cooling medium in its proximity, such as the ambient air, with it and thus cools further. In this case the gaseous cooling medium flows mostly parallel to the direction in which the filament bundle is moving. It is important that the gaseous cooling medium reach the filament bundle from at least two sides.

The self-suction unit can be created with two perforated panels, so-called double-sided panels, running parallel to the filament bundle. The length is at least 10 cm and can be up to several meters. Common lengths for these self-suction distances range from 30 cm to 150 cm.

In the method of the invention, it is preferred that the second cooling step be performed in such a way that by conducting the filaments between perforated materials, such as perforated panels, the gaseous cooling medium can reach the filaments from two sides during the self suction.

Conducting the filament bundle in the second cooling zone through a perforated tube has proven to be advantageous. Such self-suction tubes are known to those skilled in the art. They make it possible to pull the gaseous cooling medium through the filament bundle in such a way that intermingling can be mostly avoided.

It is possible to regulate the temperature of the cooling medium sucked through the filament bundle by using heat exchangers, for example. This embodiment allows a process control independent of the ambient temperature, which is advantageous for the continued stability of the process, in day/night or summer/winter differences for example.

Between the spinneret, or the nozzle plate, and the beginning of the first cooling zone there is usually a so-called "heating tube." Depending upon the type of filament, the length of this element, which is known to those skilled in the art, is between 10 and 40 cm.

Between the first and second cooling zones, a bundling step can further be advantageously implemented in a form known per se, e.g., using the so-called airmover or airknives. This bundling step can also take place within the second cooling zone.

The process according to the invention of course can include drawing of the filaments in a form known per se after the cooling zones and prior to winding. The term 'drawing' here includes all common methods known to those skilled in the art, to draw the filaments. This can be done with a single or double roll, or something similar. It must be explicitly mentioned that drawing refers to drawing ratios greater than 1 as well as ratios less than 1. The latter ratios are known to one skilled in the art under the term relaxation. Drawing ratios greater and less than 1 can occur together within one process.

The entire drawing ratio is usually calculated from the ratio of the drawing speed or, if a relaxation also takes place, the winding speed at the end of the process and the spinning speed of the filaments, i.e., the speed with which the filament bundles pass through the cooling zones. As an example, a spinning speed of 2760 m/min, drawing at 6000 m/min, with additional relaxation after the drawing of 0.5%, i.e., a winding speed of 5970 m/min, results in a total drawing ratio of 2.16.

The preferred winding speeds according to the invention are therefore at least 2000 m/min. In principle there are no top speed restrictions for the process within what is technically possible. In general, however, a top speed for winding of 6000 m/min is preferred. For the common total drawing ratios of 1.5 to 3, the spinning speed thus lies in the range of around 500 to around 4000 m/min, preferably 2000 to 3500 m/min.

Further, a quenching cell can be located upstream of the drawing device and after the cooling zones. This element is also known per se.

For the gaseous cooling medium, air or an inert gas such as nitrogen or argon is preferred.

The method of the invention is in principle not restricted to certain types of polymers and can be applied to all types of polymers that are extrudable to filaments. Polymers, such as polyester, polyamide, polyolefin, or mixtures or copolymers of these polymers, are preferred as thermoplastic material, however.

It is especially preferred that the thermoplastic material consists essentially of polyethylene terephthalate.

The method of the invention allows the production of filaments particularly suitable for technical applications, especially for use in tire cords. Moreover, the method is suitable for the fabrication of technical yarns. The necessary design for spinning technical yarns, in particular the selection of the nozzle and the length of the heating tube, is known to one skilled in the art.

The invention is therefore also directed to filament yarns, in particular polyester filament yarns, which are obtainable with the method described above.

The present invention is particularly directed to polyester filament yarns with a breaking tenacity T in mN/tex and an elongation at rupture E in %, for which the product of the breaking tenacity T and the cube root of the elongation at rupture E ($T*E^{1/3}$) is at least 1600 mN $\%^{1/3}$/tex. It is preferred that this product is between 1600 and 1800 mN $\%^{1/3}$/tex.

The measurements of the breaking tenacity T and the elongation at rupture E to determine the parameter $T*E^{1/3}$ are performed according to ASTM 885 and are known to one skilled in the art.

In a preferred embodiment, the invention is directed to polyester filament yarns, for which the sum of their elongation in % after applying a specific load EAST (elongation at specific tension) of 410 mN/tex and their hot-air shrinkage at 180° C. (HAS) in %, thus the sum of EAST+HAS, is less than 11%, preferably less than 10.5%.

Measurement of the EAST is performed according to ASTM 885, and the HAS is measured as well according to ASTM 885 on the condition that the measurement is conducted at 180° C., at 5 mN/tex, and for 2 minutes.

Finally, the present invention is directed to tire cords, which contain polyester filament yarns and in which the cord has a retention capacity Rt in %, the tire cords being distinguished in that the quality factor $Q_f$, i.e. the product of $T*E^{1/3}$ of the polyester filament yarns and Rt of the cord, is greater than 1350 mN $\%^{1/3}$/tex.

The retention capacity is to be understood as the quotient of the breaking tenacity of the cord after dipping and the breaking tenacity of the threads.

It is especially preferred to have a quality factor greater than 1375 mN $\%^{1/3}$/tex, and advantageously up to 1800 mN $\%^{1/3}$/tex.

The invention will be further explained with the help of the following examples, without being restricted to these examples.

EXAMPLES

Polyethylene terephthalate granules with a relative viscosity of 2.04 (measured with a solution of 1 g polymer in 125 g of a mixture of 2,4,6-trichlorophenol and phenol (TCF/F, 7:10 m/m) at 25° C. in an Ubbelohde viscometer (DIN 51562)) was spun and cooled under the conditions listed in Table 1. The drawing speed was 6000 m/min. An additional relaxation of 0.5% was set, with a winding speed of 5970 m/min.

TABLE 1

| | |
|---|---|
| Yarn count [dtex] | 1440 |
| Filament linear density [dtex] | 4.35 |
| Spinneret | 331 holes; diameter of 800 μm each |
| Length of the heating tube [mm] | 150 |
| Temperature in the heating tube [° C.] | 200 |
| Length of the first cooling zone [mm] | 700 |
| Air flow volume [$m^3$/h] | 400 |
| Length of the second cooling zone [mm], double-sided panel | 700 |
| Temperature of the cooling air [° C.] | 50 |
| Bundling | Airmover |

The yarn properties were determined on three samples and are shown in Table 2.

TABLE 2

| | Example 003 | Example 004 | Example 005 |
|---|---|---|---|
| Spinning speed [m/min] | 2791 | 2759 | 2727 |
| Breaking tenacity T [mN/tex] | 688 | 703 | 712 |
| Elongation at rupture E [%] | 13.9 | 13.7 | 12.9 |
| Strength at an elongation of 5% TASE5 [mN/tex] | 388 | 341 | 348 |
| $T * E^{1/3}$ [mN $\%^{1/3}$/tex] | 1654 | 1682 | 1670 |

Finally, the cord properties were determined after dipping and are summarized in Table 3.

The quality factor Qf is calculated as the product of $T*E^{1/3}$ and the retention.

TABLE 3

| | Example 003 | Example 004 | Example 005 |
|---|---|---|---|
| Breaking tenacity T [mN/tex] | 589 | 595 | 604 |
| Strength at an elongation of 5% TASE5 [mN/tex] | 227 | 223 | 222 |
| $T * E^{1/3}$ [mN $\%^{1/3}$/tex] | 1654 | 1682 | 1670 |
| Retention capacity Rt [%] | 85.6 | 84.6 | 84.8 |
| Quality factor [mN $\%^{1/3}$/tex] | 1416 | 1424 | 1417 |
| Elongation under a specific force of 410 mN/tex EAST [%] | 5.9 | 5.8 | 5.7 |
| Hot-air shrinkage (HAS) [%] | 4.2 | 4.5 | 4.3 |
| EAST + HAS [%] | 10.1 | 10.3 | 10.0 |

The invention claimed is:

1. Polyester filament yarns having a breaking tenacity T in mN/tex and an elongation at rupture E in %, wherein the product of the breaking tenacity T and the cube root of the elongation at rupture E, $T*E^{1/3}$, is at least 1600 mN $\%^{1/3}$/tex and the sum of an elongation in % after application of a specific load (EAST—elongation at specific tension) of 410 mN/tex and a hot-air shrinkage (HAS) at 180° C. in % (EAST +HAS) is less than 11%.

2. The polyester filament yarns according to claim 1, wherein the sum of EAST+HAS is less than 10.5%.

3. A cord comprising the polyester filament yarns according to claim 1, the cord having a retention capacity Rt in % after dipping, wherein a quality factor $Q_f$, which is the product of $T*E^{1/3}$ of the polyester filament yarns and Rt of the cord, is greater than 1350 mN $\%^{1/3}$/tex.

* * * * *